US005137090A

United States Patent [19]

Hare et al.

[11] Patent Number: 5,137,090

[45] Date of Patent: Aug. 11, 1992

[54] SUBSURFACE TUBING SAFETY VALVE

[75] Inventors: John P. Hare, Pearland; Thomas R. Buckner, Houston, both of Tex.

[73] Assignee: AVA International Corporation, Houston, Tex.

[21] Appl. No.: 695,275

[22] Filed: May 3, 1991

[51] Int. Cl.[5] ..... E21B 34/10

[52] U.S. Cl. ..... 166/325

[58] Field of Search ..... 166/319, 321, 323, 325, 166/373, 386

[56] References Cited

U.S. PATENT DOCUMENTS

| | | | |
|---|---|---|---|
| 2,798,561 | 7/1957 | True . | |
| 3,275,080 | 9/1966 | Nelson et al. | 166/325 |
| 3,747,618 | 7/1973 | Boes . | |
| 4,541,484 | 9/1985 | Salerni et al. | 166/325 X |
| 4,691,775 | 9/1987 | Lustig et al. | 166/325 X |

*Primary Examiner*—Thuy M. Bui

*Attorney, Agent, or Firm*—Vaden, Eickenroht, Thompson & Boulware

[57] ABSTRACT

There is disclosed a subsurface tubing safety valve of the type having a flapper pivotally mounted in the bore of a tubular body disposable in a tubing string, and a flow tube vertically reciprocable within the bore of the body between an upper position permitting the flapper to close the bore and a lower position engaging and moving the flapper into a recess in the side of the bore to open the bore. The flow tube is yieldably urged to its upper position and moved to its lower position in response to the supply of hydraulic fluid from a remote source to a piston engageable with the flow tube, and the flapper is yieldably urged to its closed position by means of an arm pivotally mounted on the body for extension over the lower surface of the flapper and a spring providing a vertically extending force acting between an end of the arm to one side of its pivotal axis and the body to urge the arm to a position to close the flapper.

11 Claims, 3 Drawing Sheets

FIG. 2
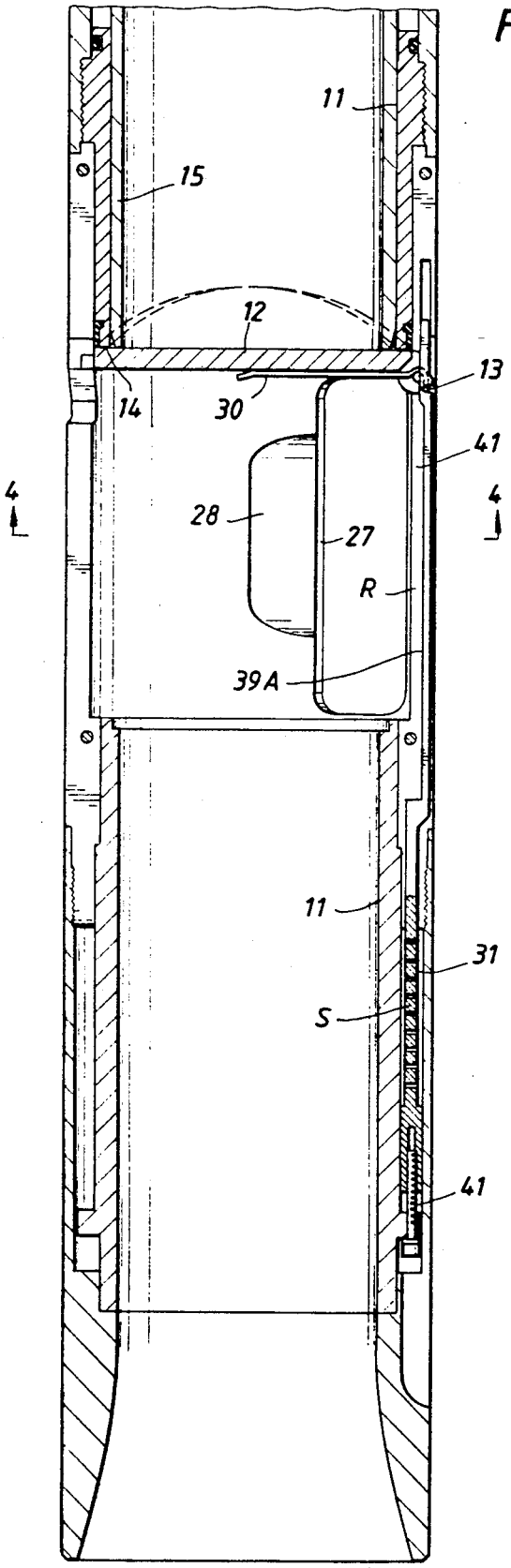
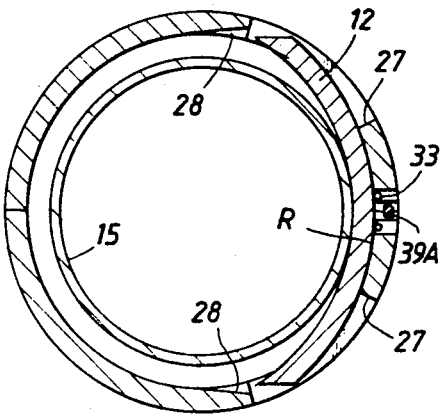
FIG. 3
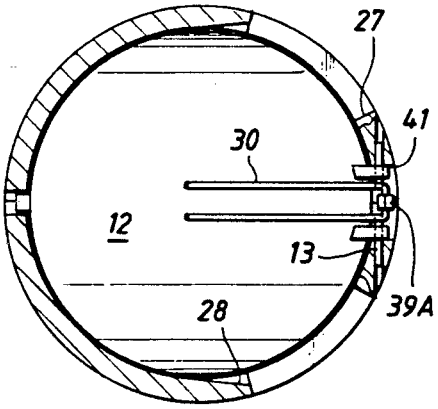
FIG. 4

SUBSURFACE TUBING SAFETY VALVE

This invention relates generally to subsurface tubing safety valves for controlling flow within a tubing string suspended within a well bore and of a type in which a flapper is pivotally mounted within a tubular body disposable within the tubing string for movement from a closed position, in which its upper surface is spring pressed against a seat about the bore, to an open position within a recess to one of the bore in response to the supply of hydraulic fluid pressure from a remote source to piston means associated with the flapper. In one of its aspects this invention relates to improvements in valves of this type in which the seat and the upper and lower surfaces of the flapper are curved about an axis transverse to the axis of the bore and the flapper is received within an arcuate recess in the side of the bore in its open position.

Conventionally, the flapper is yieldably urged to its closed position by means of a torsion spring which surrounds a pin in the body about which the flapper swings and which acts between the body and the lower surface of the flapper. As valves of this type are installed in larger diameter wells, and hence have larger bores, the flapper is necessarily larger and heavier which in turn requires larger torsion springs to move the flapper to closed position. Whether of greater length or greater coil diameter, or both, the torsion spring thus requires a thicker body which restricts the bore through the body.

The maximum outside diameter of a valve of this type, whether of the tubing mounted or wire line retrievable type, is governed by the inside diameter of the well pipe through which the valve and tubing string are to be lowered. At the same time, of course, it is desirable for the valve to have a bore as large as possible in order to maximize fluid flow therethrough. If the flapper is flat, the body must be relatively thick to provide a recess sufficiently deep to receive the flapper as it swings downwardly to open position. Hence, it has been proposed to curve both the seat in the bore and the upper and lower surfaces of the flapper about an axis perpendicular to the axis of the bore, whereby the arcuate recess in the side of the bore of the least possible depth.

The primary object of this invention is to provide a valve of this type in which the flapper is yieldably urged to closed position by means which may be disposed within a wall essentially no thicker than that required by the recess in which the flapper is received in its open position.

This and other objects are accomplished, in accordance with the illustrated embodiment of this invention, by a valve of the type described having an arm pivotally mounted on the body for engaging the flapper within the circumference of the seating surface of the flapper and spring means which is carried within the body intermediate the vertical projections of its bore and outer diameter and providing a vertically acting force between the body and the arm on one side of its pivotal axis to yieldably urge the arm in a direction to swing the flapper toward its closed position. In the preferred embodiment of the invention, the spring means engages the arm outwardly of its pivotal axis and each of the flapper and arm are pivotally mounted about a common axis, preferably the axis of the pin or pins by which the flapper is mounted.

The spring means extends downwardly from the arm and is held at its lower end to place it in tension, and, in the preferred embodiment, a means is provided for adjusting the tension in the spring means from outside of the valve. As illustrated, the spring means is of the curved beam type which extends circumferentially less than a full circle of the bore of the body. More particularly, the upper end of the spring has a lateral slot which receives the outer end of the arm as it swings about its pivotal axis between positions above and below said axis. As illustrated, the flapper and arm are pivotally mounted on spaced pins on opposite sides of the vertical path of movement and the arm is of a "U" shape whose closed outer end is received in the slot.

Preferably, the flapper is of the curved type, and there is a sufficient freedom of movement in the pivotal mounting of the flapper about the pin to permit the upper curved surface of the flapper to be free to seek full circle engagement with the curved seat in the bore. More particularly, the outer end of the arm engages the flapper at approximately its center.

In the drawings, wherein like reference characters are used throughout to designate like parts. .

FIG. 2 is a view similar to FIG. 1B, but swinging of the flapper to closed position;

FIG. 3 is a cross-sectional view of the valve, as seen along broken lines 3—3 of FIG. 1B;

FIG. 4 is a cross-sectional view of the valve, as seen along broken lines 4—4 of FIG. 2;

Figure 1A:
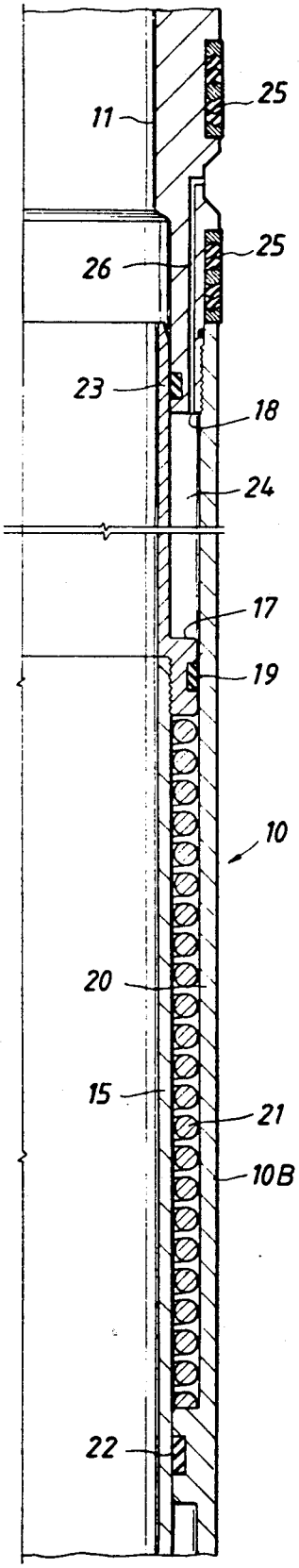
FIG. 1A is a half vertical sectional view and FIG. 1B is a full vertical sectional view of the upper and lower ends respectively, of a subsurface tubing safety valve constructed in accordance with the present invention and with the flapper to its open position.
Figure 1B:
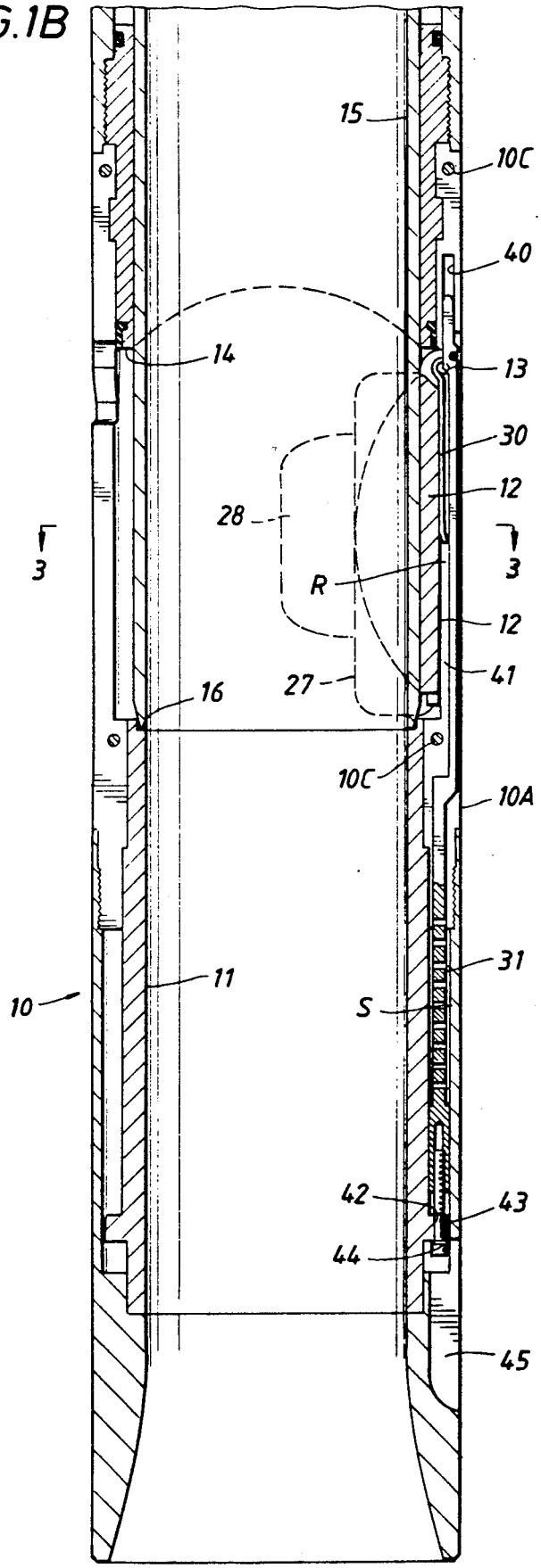

With reference now to the detail of the above-described drawings, the sub-surface safety valve shown in FIGS. 1A and 1B is of the wireline retrievable type having a tubular body 10 which is removably mountable within a tubing string adapted to be suspended within a well bore and which has a bore therethrough which forms a continuation of the flowway through the tubing string when so connected. The valve also includes a flapper 12 which is pivotally mounted about pins 13 carried by the body outwardly of the bore for swinging between a position within a recess R in one side of the bore beneath the seat to open the valve, as shown in FIG. 1B, and the position of FIG. 2 wherein it engages a downwardly facing seat 14 about the bore in order to close the valve.

In a manner well known in the art, suitable parts are provided on the body and within the bore of the tubing string for releasably locking it in landed position therein. The invention contemplates, however, that the valve may instead be a tubing mounted type in which its body is connected as part of the tubing string, but in any case, disposable therein during operation of the valve.

The flapper is yieldably urged to its closed position in a manner which will be described in more detail to follow, and, in the illustrated embodiment of the invention, is adapted to be moved to its open position by means of a flow tube 15 vertically reciprocable within the body and forming a continuation of its bore 11. Thus, as the flow tube is lowered from its position of FIG. 2, in which its lower edge is above the flapper to permit it to close, it engages the upper surface of the flapper to swing it downwardly and outwardly to its open position in the recess. On the other hand, when the flow tube is raised to its upper position, in a manner to be described to follow, it permits the flapper to be swung back to its fully closed position of FIG. 2.

When the flow tube is moved downwardly past the flapper, its lower end engages an upwardly facing shoulder 16 about the bore. When the flow tube is moved upwardly to permit the flapper to close, an upwardly facing shoulder 17 thereabout engages a downwardly facing shoulder 18 of the body to limit further upward movement of the flow tube.

More particularly, the shoulder 17 is formed on the upper end of a piston 19 about the flow tube which is sealably slidable within an enlarged inner diameter portion 20 of the body, and the flow tube is yieldably urged to its upper position by means of an elongate coil spring 21 disposed within an annular space about and compressed axially between the lower end of the piston 19 and the upper end of a reduced portion of the body having a bearing 22 which surrounds the flow tube.

The upper end of the flow tube is sealably slidable within an upper reduced diameter portion 23 of the body to form an annular pressure chamber 24 between the shoulders 17 and 18. The flow tube is adapted to be moved downwardly in order to open the valve by the supply of fluid pressure to the pressure chamber. For this purpose, the packing 25 is carried about the body above and below the upper end of a passageway 26 in the valve body connecting at its lower end with the pressure chamber 24. When the body of the valve is landed in the tubing string, the upper end of passageway 26 connects with the lower end of a tube (not shown) which extends downwardly along the outside of the tubing from a pressurized source of hydraulic fluid at the well head. Of course, upon the exhaust of such source, the coil spring 21 raises the flow tube to permit the flapper to close.

As previously described, and as shown in the drawings, the seat 14 in the bore of the body is curved about an axis perpendicular to the axis of the bore, and the upper surface of the flapper is similarly curved for sealably engaging the seat in its closed position. More particularly, and as illustrated in FIG. 3, both the upper and lower surfaces of the flapper are curved to a radius substantially equal to but somewhat larger than the radius of the bore through the body so that, when the flapper is moved into the recess, its upper surface is aligned with the bore and thus, of course, with the outer diameter of the flow tube.

As shown in FIG. 3, windows 27 are formed in the valve body to accommodate the ends of the flapper in its open position. In addition, the bore of the body is relieved at 28 to receive diametrical portions of the flapper as it is swung between open and closed positions.

In accordance with the novel aspects of the present invention, the flapper 12 is yieldably urged to its closed position by means which includes an arm 30 pivotally mounted on the body for extension over the lower surface of the flapper, and a spring 31 which is carried within the body intermediate its bore and outer diameter and which acts between the body and the arm to one side of its pivotal axis to provide a vertically extending force to yieldably urge the arm in a direction to swing the flapper toward its closed position.

Figure 5:
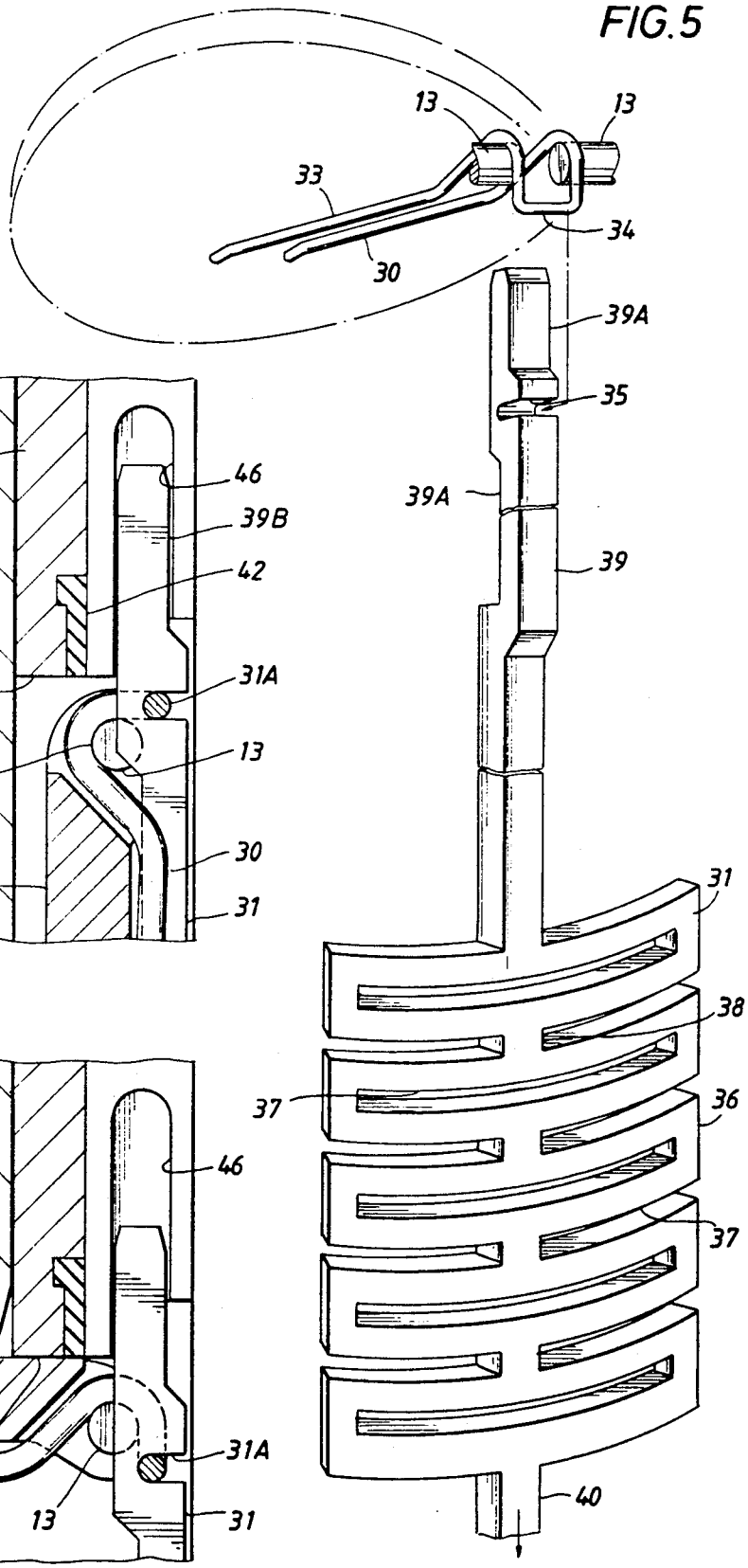
FIG. 5 is a perspective, exploded view of the arm and spring for urging the flapper to closed position.
Figure 6:
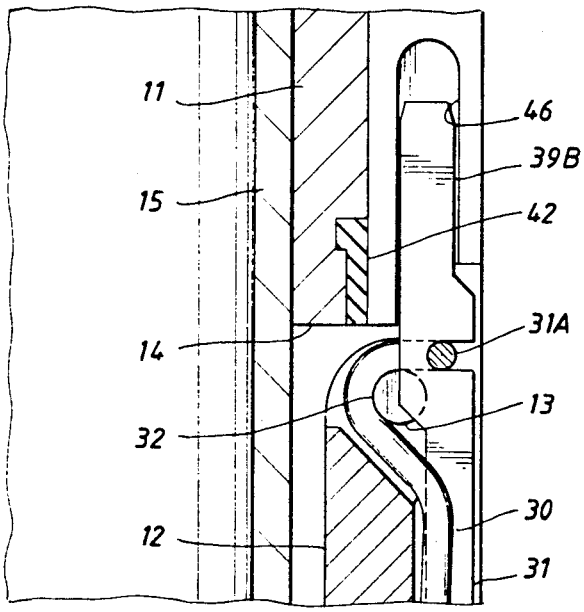
FIG. 6 is a detailed sectional view of the outer end of the arm mounted on the pins on which the flapper is mounted and the connection of the upper end of the spring to the outer end of the arm when the flapper is open.
Figure 7:
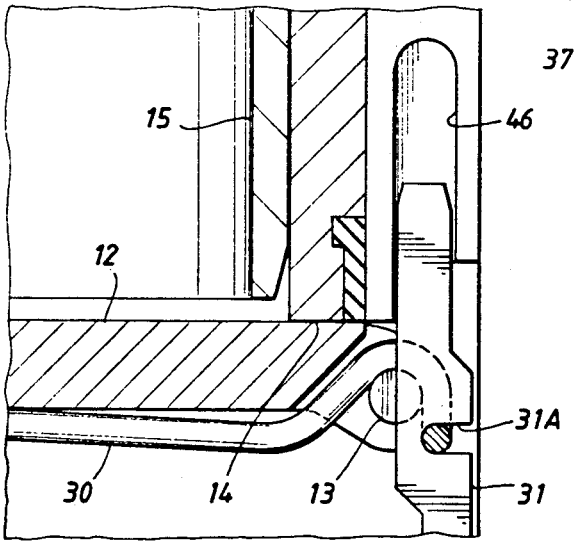
FIG. 7 is a view similar to FIG. 6, but showing the connection of the spring to the arm when the flapper is closed.

More particularly, and as best shown in FIGS. 5-7, the arm is "U" shaped and includes an outer hook portion 32 which fits over the pivot pins 13 and an elongate inner end portion 33 which extends over a substantial portion of the lower surface of the flapper. The closed outer end 34 of the arm is received in a slot 31A in the upper end of the spring 31 for swinging about the axis of the pivot pins as the flapper moves between its open and closed positions. During this movement, the upper end of the arm will move laterally within the slot between its innermost positions of FIGS. 6 and 7 above and below the pivotal axis of the pin and an outermost position (not shown) horizontally opposite the axis in which it is spaced to the right of the inner end of the slot. The lower end of the spring is closely movable vertically within an annular space S in the valve body so as to maintain the upper end of the arm captured within the slot.

As shown in FIG. 5, the spring 31 is of the curved beam type comprising an intermediate arcuate section 36 having slots 37 formed therethrough to provide individually flexible, curved beams throughout the length of the body portion. Thus, as shown, the slots are staggered laterally so that vertically adjacent beams overlap one another throughout the length of the body portion. The slots which extend inwardly from opposite sides of the body portion 36 are spaced from one another by short legs 38.

The spring also includes an upper elongate portion 39 having an upper end in which the slot 31A is formed and a lower elongate portion 40 which extends downwardly from arcuate section 36 in general alignment with the upper portion 39 and which is held at its lower end by means of a threaded bolt 41. As shown in FIGS. 1B and 2, the bolt extends through a hole 42 in a flange 43 of the valve body at the lower end of the annular space S in which the body portion of the spring is received, and has a head 44 at its lower end which bears against the lower side of the flange. Thus, when the bolt is properly made up with the lower end of the spring, it places the spring in tension so as to act upon the end 31A of the arm to swing the arm in a clockwise direction and thus swing the flapper to its closed position. An opening 45 formed in the outer diameter of the tubular body permits access to the head 44 of the bolt to adjust the tension in the spring when the valve is removed from within the tubing string.

The upper portion 39 of the spring has an outwardly recessed portion 39A which, as best shown in FIGS. 1B and 2, conforms to the recess in the bore of the body to accommodate the flapper in its open position. The uppermost end 39B of the upper portion 39 extends upwardly into a slot 46 in the valve body.

As best shown in FIG. 3, pins 13 are spaced apart to permit the upper portion of the spring to move vertically between them, and the legs of the "U" shaped arm are each supported on one of the pins. As shown, the inner end of the arm engages the flapper at its center, so that, with the openings in the flapper in which the pins are received of somewhat larger diameter than the pins, the flapper well bore permits some freedom of movement with respect to the pins, whereby the upper surface of the flapper is free to assume a full circle engagement with the seat in the bore of the body.

For assembly purposes, the tubular body 10 of the valve includes a lower tubular section 10A threadedly connected to a section 10B thereabove and comprising circumferentially split parts which are aligned with one another, during assembly, by dowel pins C. The slot 46 in which the uppermost end 39B of the spring is received is of course comprised of recessed portion on opposite faces of the adjacent ends of the tubular body sections, 10A. As shown in FIG. 4, the opposite faces of the body sections are also slotted to accommodate the upper portion 39A of the spring as well as the arm 30 when the flapper is in its open position.

Preferably, a seal ring 42 is carried by the tubular body at the outer diameter of the seat 14 whereby the flapper will form a sealed engagement with the seat in its closed position. From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A subsurface tubing safety valve, comprising a tubular body disposable within a tubing string and having a downwardly facing seat which surrounds its bore, a flapper mounted on the body for pivotal movement between a closed position in which it sealably engages the seat and an open position within a recess in the side of the bore, means including piston means sealably slidable within the body and being lowerable, in response to the supply of hydraulic fluid thereto from a remote source, in order to swing said flapper to its open position, and means yieldably urging the flapper to closed position comprising an arm pivotally mounted on the body for engaging the flapper within the circumference of the seat, when closed, and spring means carried within the body intermediate the vertical projections of its bore and outer diameter and providing a vertically acting force between the body and the arm on one side of its pivotal axis to yieldably urge the arm in a direction to swing the flapper toward its closed position.

2. A subsurface tubing safety valve of the character defined in claim 1, wherein the spring means engages the arm outwardly of its pivotal axis.

3. A subsurface tubing safety valve of the character defined in claim 2, wherein each of the flapper and arm are pivotally mounted about a common axis.

4. A subsurface tubing safety valve of the character 1, in claim 3, wherein each of the flapper and arm are pivotally mounted about a common pin.

5. A subsurface tubing safety valve of the character defined in claim 2, wherein the spring means is connected to and extends downwardly from the arm and is held at its lower end to place it in tension.

6. A subsurface tubing safety value of the character in claim 5, including means accessible from the outside of the body to permit adjustment of the tension in the spring means.

7. A subsurface tubing safety valve of the character defined in claim 1, wherein the spring means is of the curved beam type and extends circumferentially less than a full circle of the bore of the body.

8. A subsurface tubing safety valve of the character defined in claim 5, wherein the upper end of the spring means has a lateral slot which receives the outer end of the arm as the arm swings about its pivotal axis between positions above and below said axis.

9. A subsurface tubing safety valve of the character defined in claim 8, wherein the flapper is pivotally mounted on spaced pins, the upper end of the spring means moves vertically between the pins, and the arm has a "U" shaped outer end which is received in the slot.

10. A subsurface tubing safety valve of the character defined in claim 1, wherein the arm has an outer end which engages the lower surface of the flapper at approximately its center.

11. A subsurface tubing safety valve of the character in claim 1, wherein the seat is curved about an axis transverse to the axis of the bore of the body, the flapper has an upper curved surface which engages the seat in its closed position and a lower curved surface which moves into an arcuate recess in the side of the bore in its open position, and the flapper has sufficient freedom of movement about its pivotal axis to permit its upper surface to seek full circle engagement with the seat.

* * * * *